US010147525B1

(12) United States Patent
Chen et al.

(10) Patent No.: US 10,147,525 B1
(45) Date of Patent: Dec. 4, 2018

(54) PTC CIRCUIT PROTECTION DEVICE

(71) Applicant: FUZETEC TECHNOLOGY CO., LTD., New Taipei (TW)

(72) Inventors: Jack Jih-Sang Chen, New Taipei (TW); Chang-Hung Jiang, New Taipei (TW)

(73) Assignee: Fuzetec Technology Co., Ltd., New Taipei (TW)

( * ) Notice: Subject to any disclaimer, the term of this patent is extended or adjusted under 35 U.S.C. 154(b) by 0 days.

(21) Appl. No.: 15/850,519

(22) Filed: Dec. 21, 2017

(51) Int. Cl.

| | |
|---|---|
| ***H01C 7/02*** | (2006.01) |
| ***H01C 1/14*** | (2006.01) |
| ***H01C 17/065*** | (2006.01) |
| ***H01C 7/00*** | (2006.01) |

(52) U.S. Cl.
CPC ..... *H01C 7/028* (2013.01); *H01C 1/1406* (2013.01); *H01C 7/008* (2013.01); *H01C 7/027* (2013.01); *H01C 17/0652* (2013.01); *H01C 17/06586* (2013.01)

(58) Field of Classification Search
CPC ..... H01C 7/028; H01C 1/1406; H01C 7/008; H01C 7/027; H01C 17/0652; H01C 17/06586
USPC ..... 338/22 R
See application file for complete search history.

(56) References Cited

U.S. PATENT DOCUMENTS

| | | | | |
|---|---|---|---|---|
| 8,368,504 | B1 * | 2/2013 | Chen | H01C 7/02 252/511 |
| 8,558,655 | B1 * | 10/2013 | Chen | H01C 7/027 338/13 |
| 9,502,162 | B2 * | 11/2016 | Chen | H02H 5/04 |
| 9,502,163 | B2 * | 11/2016 | Chen | H01C 7/027 |
| 9,773,589 | B1 * | 9/2017 | Chen | H01C 7/028 |
| 2013/0021134 | A1 * | 1/2013 | Chen | H01C 7/027 338/22 R |
| 2014/0146432 | A1 * | 5/2014 | Wang | H01C 7/021 361/93.7 |
| 2016/0093414 | A1 * | 3/2016 | Ho | H01B 1/20 338/22 R |

* cited by examiner

*Primary Examiner* — Kyung Lee
(74) *Attorney, Agent, or Firm* — Michael Best & Friedrich LLP

(57) ABSTRACT

A PTC circuit protection device includes a PTC polymer material and two electrodes attached to the PTC polymer material. The PTC polymer material includes a polymer matrix and a particulate conductive filler dispersed in the polymer matrix. The polymer matrix is made from a polymer composition that contains a non-grafted polyolefin. The conductive filler includes tungsten carbide particles having a total carbon content that is less than 6.0 wt % based on the total weight of the tungsten carbide particles.

8 Claims, 1 Drawing Sheet

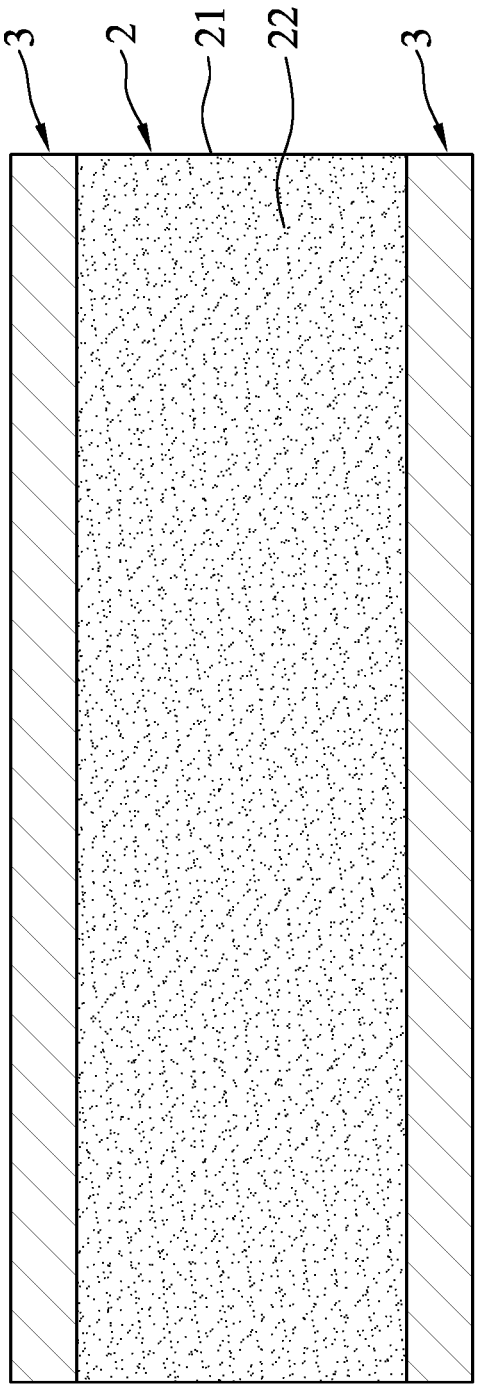
3
2
21
22
3

PTC CIRCUIT PROTECTION DEVICE

FIELD

This disclosure relates to a PTC circuit protection device, more particularly to a PTC circuit protection device including a PTC polymer material.

BACKGROUND

A positive temperature coefficient (PTC) element exhibits a PTC effect that renders the same usefulness as a circuit protecting device, such as a resettable fuse. The PTC element includes a PTC polymer material and first and second electrodes attached to two opposite surfaces of the PTC polymer material.

The PTC polymer material includes a polymer matrix that contains a crystalline region and a non-crystalline region, and a particulate conductive filler dispersed in the non-crystalline region of the polymer matrix and formed into a continuous conductive path for electrical conduction between the first and second electrodes. The PTC effect is a phenomena that, when the temperature of the polymer matrix is raised to its melting point, crystals in the crystalline region start melting, which results in the generation of a new non-crystalline region. As the new non-crystalline region is increased to an extent and merges into the original non-crystalline region, the conductive path of the particulate conductive filler will become discontinuous and the resistance of the PTC polymer material will be sharply increased, thereby resulting in an electrical disconnection between the first and second electrodes.

Tungsten carbide particles are used in PTC elements as the particulate conductive filler. The existing PTC elements containing the tungsten carbide particles are usually operated at 6 Vdc. However, when such PTC elements are operated at a relatively high voltage (e.g., 12 Vdc), the stability thereof is unsatisfactory and needs to be improved.

SUMMARY

Therefore, an object of the present disclosure is to provide a PTC circuit protection device that can overcome the aforesaid drawback associated with the prior art.

According to this disclosure, the PTC circuit protection device includes a PTC polymer material and two electrodes. The PTC polymer material includes a polymer matrix and a particulate conductive filler dispersed in the polymer matrix. The two electrodes are attached to the PTC polymer material. The polymer matrix is made from a polymer composition that contains a non-grafted polyolefin. The conductive filler includes first tungsten carbide particles having a total carbon content that is less than 6.0 wt % based on the total weight of the first tungsten carbide particles.

BRIEF DESCRIPTION OF THE DRAWINGS

Other features and advantages of the disclosure will become apparent in the following detailed description of the embodiment with reference to the accompanying drawing, of which:

FIG. 1 is a schematic view of the embodiment of a PTC circuit protection device according to this disclosure.

DETAILED DESCRIPTION

FIG. 1 illustrates the embodiment of a PTC circuit protection device that includes a PTC polymer material 2 and two electrodes 3.

The PTC polymer material 2 includes a polymer matrix 21 and a particulate conductive filler 22 dispersed in the polymer matrix 21. The two electrodes 3 are respectfully attached to two opposite surfaces of the PTC polymer material 2.

The polymer matrix 21 is made from a polymer composition that contains a non-grafted polyolefin.

In certain embodiments, the non-grafted polyolefin is non-grafted polyethylene. In certain embodiments, the non-grafted polyolefin is high density polyethylene (HDPE).

In certain embodiments, the polymer matrix 21 further includes a grafted polyolefin. In certain embodiments, the grafted polyolefin is carboxylic acid anhydride-grafted polyethylene. The carboxylic acid anhydride-grafted polyethylene may be carboxylic acid anhydride-grafted high density polyethylene. In this embodiment, the carboxylic acid anhydride-grafted high density polyethylene is maleic anhydride-grafted high density polyethylene.

The conductive filler 22 includes first tungsten carbide particles having a total carbon content that is less than 6.0 wt % based on the total weight of the first tungsten carbide particles.

In certain embodiments, the first tungsten carbide particles have a total carbon content ranging from 5.0 wt % to 6.0 wt % based on the total weight of the first tungsten carbide particles.

In certain embodiments, the first tungsten carbide particles have a total carbon content ranging from 5.5 wt % to 5.9 wt % based on the total weight of the first tungsten carbide particles.

In certain embodiments, the conductive filler 22 may further include second tungsten carbide particles having a total carbon content of 6.1 wt % based on the total weight of the second tungsten carbide particles.

In certain embodiments, based on the total weight of the PTC polymer material 2, the polymer matrix 21 is in an amount ranging from 4 to 8 wt % and the particulate conductive filler 22 is in an amount ranging from 92 to 96 wt %. In certain embodiments, the PTC polymer material 2 includes at least 2 wt % of the first tungsten carbide particles based on the total weight of the PTC polymer material 2.

The disclosure will be further described by way of the following examples and comparative example. However, it should be understood that the following examples and comparative example are solely intended for the purpose of illustration and should not be construed as limiting the disclosure in practice.

EXAMPLE

Example 1(E1)

10.5 grams of HDPE (purchased from Formosa Plastics Corp., catalog no.: HDPE9002) serving as the non-grafted polyolefin, 10.5 grams of maleic anhydride grafted HDPE (purchased from Dupont, catalog no.: MB100D) serving as the carboxylic acid anhydride-grafted polyolefin, 279 grams of tungsten carbide particles (made in the presence of hydrogen at about 1750° C., having a total carbon content of 5.9 wt % and an average particle size of 2.0 μm (measured using a Fisher Sub-sieve Sizer)) serving as the first tungsten carbide particles were compounded in a Brabender mixer. The compounding temperature was 200° C., the stirring rate was 50 rpm, the pressing weight was 5 kg, and the compounding time was 10 minutes.

The compounded mixture was hot pressed so as to form a thin sheet of the PTC polymer material 2 having a thickness of 0.28 mm. The hot pressing temperature was 200° C., the hot pressing time was 4 minutes, and the hot pressing pressure was 80 kg/cm2.

Two copper foil sheets (serving as the electrodes 3) were respectively attached to two opposite surfaces of the thin sheet and were hot pressed under 200° C. and 80 kg/cm2 for 4 minutes to form a sandwiched structure of a PTC laminate. The PTC laminate was cut into a plurality of test samples with a size of 4.5 mm×3.2 mm, and each test sample was irradiated by a cobalt-60 source with a total radiation dose of 150 kGy.

The electrical properties of the test samples were determined and recorded in Table 1.

Examples 2 and 3 (E2 and E3)

The procedures and conditions in preparing the test samples of Examples 2 and 3 (E2 and E3) were similar to those of Example 1, except for the amounts of the first tungsten carbide particles, HDPE, and grafted-HDPE.

The electrical properties of the test samples of Examples 2 and 3 (E2 and E3) were determined, and the results are shown in Table 1.

Examples 4 to 8 (E4-E8)

The procedures and conditions in preparing the test samples of Examples 4 to 8 (E4-E8) were similar to those of Example 2, except for the total carbon content and the average particle size of the first tungsten carbide particles.

The electrical properties of the test samples of Examples 4-8 were determined, and the results are shown in Table 1.

Examples 9 to 12 (E9-E12)

The procedures and conditions in preparing the test samples of Examples 9 to 12 (E9-E12) were similar to those of Example 2, except that the particulate conductive fillers of Examples 9 to 12 further include second tungsten carbide particles.

The second tungsten carbide particles used in each of Examples 9-12 have a total carbon content of 6.1 wt % based on the total weight of the second tungsten carbide particles. The amounts of the first and second tungsten carbide particles are listed in Table 1.

The electrical properties of the test samples of Examples 9-12 were determined, and the results are shown in Table 1.

Comparative Example 1 (CE1)

The procedures and conditions in preparing the test samples of Comparative Example 1 (CE1) were similar to those of Example 1, except for the amounts of HDPE and grafted-HDPE and the amount and type of the particulate conductive filler. In Comparative Example 1, the particulate conductive filler is titanium carbide(having an average particle size of 1.35 μm and a residual oxygen content of 0.9%). The electrical properties of the test samples of Comparative Example 1 (CE1) were determined, and the results are shown in Table 1.

Comparative Examples 2-7 (CE2-CE7)

The procedures and conditions in preparing the test samples of Comparative Examples 2-7 (CE2-CE7) were similar to those of Example 1, except for the amounts of HDPE and grafted-HDPE and the amount and type of the particulate conductive filler (please see Table 1). The electrical properties of the test samples of Comparative Examples 2-7 were determined, and the results are shown in Table 1.

TABLE 1

| | Polymer matrix | | Particulate conductive filler | | | | |
|---|---|---|---|---|---|---|---|
| | | | First tungsten carbide particles | | | | |
| | HPDE (wt %) | Grafted-HPDE (wt %) | Type | Particle size (μm) | Total carbon (wt %) | W(wt %)C(wt %) | wt % |
| E1 | 3.5 | 3.5 | WC | 2.0 | 5.9 | W(94.1)C(5.9) | 93.0 |
| E2 | 3.0 | 3.0 | WC | 2.0 | 5.9 | W(94.1)C(5.9) | 94.0 |
| E3 | 2.5 | 2.5 | WC | 2.0 | 5.9 | W(94.1)C(5.9) | 95.0 |
| E4 | 3.0 | 3.0 | WC | 2.0 | 5.5 | W(94.5)C(5.5) | 94.0 |
| E5 | 3.0 | 3.0 | WC | 2.0 | 5.8 | W(94.2)C(5.8) | 94.0 |
| E6 | 3.0 | 3.0 | WC | 2.0 | 5.6 | W(94.4)C(5.6) | 94.0 |
| E7 | 3.0 | 3.0 | WC | 2.0 | 3.9 | W(96.1)C(3.9) | 94.0 |
| E8 | 3.0 | 3.0 | WC | 2.0 | 4.7 | W(95.3)C(4.7) | 94.0 |
| E9 | 3.0 | 3.0 | WC | 2.0 | 5.9 | W(94.1)C(5.9) | 2.0 |
| E10 | 3.0 | 3.0 | WC | 2.0 | 5.9 | W(94.1)C(5.9) | 25.0 |
| E11 | 3.0 | 3.0 | WC | 2.0 | 5.9 | W(94.1)C(5.9) | 50.0 |
| E12 | 3.0 | 3.0 | WC | 2.0 | 5.9 | W(94.1)C(5.9) | 75.0 |
| C1 | 5.0 | 5.0 | TiC | 1.35 | 20.4 | Ti(79.6)C(20.4) | 90.0 |
| C2 | 3.5 | 3.5 | WC | 2.0 | 6.1 | W(93.9)C(6.1) | 93.0 |
| C3 | 3.0 | 3.0 | WC | 2.0 | 6.1 | W(93.9)C(6.1) | 94.0 |
| C4 | 2.5 | 2.5 | WC | 2.0 | 6.1 | W(93.9)C(6.1) | 95.0 |
| C5 | 3.0 | 3.0 | WC | 2.0 | 6.1 | W(93.9)C(6.1) | 94.0 |
| C6 | 3.0 | 3.0 | WC | 2.0 | 6.0 | W(94.0)C(6.0) | 94.0 |
| C7 | 3.0 | 3.0 | WC | 2.0 | 6.0 | W(94.0)C(6.0) | 94.0 |
| | | | Second tungsten carbide particles | | | | |
| | | | Type | Particle size (μm) | Total carbon (wt %) | W(wt %)C(wt %) | wt % |
| | | E1 | | | | | |
| | | E2 | | | | | |
| | | E3 | | | | | |

TABLE 1-continued

| | | | | | |
|---|---|---|---|---|---|
| E4 | | | | | |
| E5 | | | | | |
| E6 | | | | | |
| E7 | | | | | |
| E8 | | | | | |
| E9 | WC | 2.0 | 6.1 | W(93.9)C(6.1) | 92.0 |
| E10 | WC | 2.0 | 6.1 | W(93.9)C(6.1) | 69.0 |
| E11 | WC | 2.0 | 6.1 | W(93.9)C(6.1) | 44.0 |
| E12 | WC | 2.0 | 6.1 | W(93.9)C(6.1) | 19.0 |
| C1 | | | | | |
| C2 | | | | | |
| C3 | | | | | |
| C4 | | | | | |
| C5 | | | | | |
| C6 | | | | | |
| C7 | | | | | |

| | Test sample Device | Switching cycle test (12 Vdc/10A, 7200 cycles) | | Aging test (12 Vdc/10A, 1000 hours) | |
|---|---|---|---|---|---|
| | Ri (ohm) | Rf/Ri (%) | Pass (%) | Rf/Ri (%) | Pass ratio (%) |
| E1 | 0.00459 | 1777% | 100% | 970% | 100% |
| E2 | 0.00423 | 1678% | 100% | 853% | 100% |
| E3 | 0.00441 | 1886% | 100% | 899% | 100% |
| E4 | 0.00401 | 1656% | 100% | 765% | 100% |
| E5 | 0.00497 | 1750% | 100% | 811% | 100% |
| E6 | 0.00416 | 1731% | 100% | 860% | 100% |
| E7 | 0.00823 | 8225% | 70% | 9425% | 80% |
| E8 | 0.00716 | 9967% | 80% | 9534% | 80% |
| E9 | 0.00556 | 1969% | 100% | 769% | 100% |
| E10 | 0.00520 | 1884% | 100% | 941% | 100% |
| E11 | 0.00487 | 1798% | 100% | 823% | 100% |
| E12 | 0.00442 | 1771% | 100% | 803% | 100% |
| C1 | 0.00684 | 1384501% | 10% | 220154% | 10% |
| C2 | 0.00716 | 11223% | 30% | 9342% | 30% |
| C3 | 0.00605 | 10008% | 30% | 9672% | 30% |
| C4 | 0.00623 | 15989% | 10% | 9041% | 10% |
| C5 | 0.00711 | 12311% | 20% | 10321% | 20% |
| C6 | 0.00698 | 10996% | 20% | 9971% | 30% |
| C7 | 0.00601 | 10034% | 40% | 9065% | 50% |

Performance Tests

Switching Cycle Test

Two nickel foil sheets were respectively attached to two copper foil sheets of each test samples to form test devices for each of E1 to E12 and CE1 to CE7.

Ten test devices for each of E1 to E12 and CE1 and CE2 were subjected to a switching cycle test.

The switching cycle test was conducted under a voltage of 12 Vdc and a current of 10 A by switching each test device on for 60 seconds and then off for 60 seconds per cycle for 7200 cycles. The resistances of each test device before (Ri) and after (Rf) the 7200 cycles were measured. An average percentage of variation (Rf/Ri □ 100%) of the resistances of the test devices for each of E1 to E12 and CE1 to CE7 was determined. A pass ratio is calculated based on the formula: n/10 □ 100%, in which n represents the number of the test devices passing the switching cycle test without being burnt. The results of the switching cycle test are shown in Table 1.

Table 1 shows that the test devices of each of E1 to E12 have a significantly higher pass ratio (70% to 100%) than those of CE1 to CE7 (10% and 40%).

Aging Test

Ten test samples for each of E1 to E12 and CE1 to CE7 were subjected to an aging test. The aging test was conducted by applying a voltage of 12 Vdc and a current of 10 A to each test sample for 1000 hours. The resistances of each test sample before (Ri) and after (Rf) the 1000 hours were measured. An average percentage of variation (Rf/Ri □ 100%) of the resistances of the test sample for each of E1 to E12 and CE1 to CE7 was determined. A pass ratio is calculated based on the formula: n/10 □ 100%, in which n represents the number of the test samples passing the aging test without being burnt. The results of the aging test are shown in Table 1.

The results reveal that the pass ratio of E1 to E12 (80% to 100%) are much higher than those of CE1 and CE7 (10% to 50%), which demonstrates that the PTC circuit protection device of the present disclosure is more reliable.

In conclusion, with the inclusion of the first tungsten carbide particles having a total carbon content that is less than 6.0 wt %, the PTC circuit protection device of the present disclosure could be operated under 12 Vdc and still exhibits good reliability.

In the description above, for the purposes of explanation, numerous specific details have been set forth in order to provide a thorough understanding of the embodiment(s). It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, FIGURE, or description thereof for the purpose of streamlining the disclosure and aiding in the understanding of various inventive aspects.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A PTC circuit protection device comprising:

a PTC polymer material that includes a polymer matrix and a particulate conductive filler dispersed in said polymer matrix; and two electrodes attached to said PTC polymer material;

wherein said polymer matrix is made from a polymer composition that contains a non-grafted polyolefin; and wherein said conductive filler includes first tungsten carbide particles having a total carbon content ranging from 5.0 wt % to 6.0 wt % based on the total weight of said first tungsten carbide particles.

2. The PTC circuit protection device of claim 1, wherein said first tungsten carbide particles have a total carbon content ranging from 5.5 wt % to 5.9 wt % based on the total weight of said first tungsten carbide particles.

3. The PTC circuit protection device of claim 1, wherein said conductive filler further includes second tungsten carbide particles, said second tungsten carbide particles have a total carbon content of 6.1 wt % based on the total weight of said second tungsten carbide particles.

4. The PTC circuit protection device of claim 1, wherein said PTC polymer material includes at least 2 wt % of said first tungsten carbide particles based on the total weight of said PTC polymer material.

5. The PTC circuit protection device of claim 1, wherein said polymer matrix is in an amount ranging from 4 to 8 wt % and said conductive filler is in an amount ranging from 92 to 96 wt % based on the total weight of said PTC polymer material.

6. The PTC circuit protection device of claim 1, wherein said non-grafted polyolefin is high density polyethylene.

7. The PTC circuit protection device of claim 1, wherein said polymer composition further includes a grafted polyolefin.

8. The PTC circuit protection device of claim 1, wherein said grafted polyolefin is carboxylic acid anhydride-grafted high density polyethylene.

* * * * *